US005467498A

United States Patent [19]

Keegan et al.

[11] Patent Number: 5,467,498

[45] Date of Patent: Nov. 21, 1995

[54] SELF-SHARPENING SCRAPING TOOL

[76] Inventors: Joseph P. Keegan, 530 Fish Rock Rd., Southbury, Conn. 06488; Thomas E. Devlin, 97 Brookline St. #3, Cambridge, Mass. 02139

[21] Appl. No.: 135,341

[22] Filed: Oct. 13, 1993

[51] Int. Cl.[6] ..... A47L 13/08

[52] U.S. Cl. ..... 15/236.05; 7/105; 30/138; 30/169; 30/172; 451/558; 15/236.01

[58] Field of Search ..... 15/105, 236.01, 15/236.05; 7/105, 170; 30/138, 169, 172; 451/557, 558

[56] References Cited

U.S. PATENT DOCUMENTS

| | | | |
|---|---|---|---|
| 822,928 | 6/1906 | Delano | 15/105 |
| 1,163,950 | 12/1915 | Patterson | 51/205 WG |
| 1,854,286 | 4/1932 | Abrahamsen | 30/138 |
| 2,764,854 | 10/1956 | Menken | 510/205 R |
| 3,250,000 | 5/1966 | Schumann | 15/236.05 |
| 4,501,068 | 2/1985 | Palson | 30/138 |
| 4,984,324 | 1/1991 | Farris | 15/236.05 |

FOREIGN PATENT DOCUMENTS

| | | | |
|---|---|---|---|
| 11121 | of 1914 | United Kingdom | 30/138 |
| 298797 | 11/1927 | United Kingdom | 30/138 |

*Primary Examiner*—Mark Spisich
*Attorney, Agent, or Firm*—Lawrence Hager

[57] ABSTRACT

A self-sharpening type scraping tool having particular utility for scraping surfaces such as to remove paint from walls of a structure, in which the manual actuation of the tool simultaneously effects sharpening of one or more blade edges. A rectangular/square shaped plate is pivotally mounted to a base member and contains a projecting blade on each side of the plate member. Sharpening member is provided for sharpening one or more the blades performed by the tool operator.

5 Claims, 6 Drawing Sheets

SELF-SHARPENING SCRAPING TOOL

FIELD OF THE INVENTION

This invention relates to hand tools and, in particular, to a hand held scraper tool of improved construction and utility.

BACKGROUND OF THE INVENTION

Typically, a scraper tool is characterized by a handle and a base defining a mounting platform for a scraper blade. The scraper blade is locked into ridged position to the base by means of a bolt. When the scraper blade edges are dull, the scraper blade is removed from the tool for sharpening or replacement.

BRIEF STATEMENT OF THE PRIOR ART

The prior art includes several scraping tool designs which employ replaceable scraper blades. One such prior art tool is illustrated in U.S. Pat. No. 3,250,000 issued Sep. 14, 1964 to L. R. Schumann. This patent shows a pair of scraper edges on each of only two opposite sides of a plate. The plate is fixed into position on the tool by means of a nut and bolt to rigidly secure the plate to the flat surface of the tool head. Thus, this device utilizes a scraper blade which does not contain blade (scraping) edges on all four sides and is not designed for movement relative to the tool head/handle.

Other prior art patents of some interest include U.S. Pat. Nos. 5,001,796 issued Mar. 26, 1991 to Warren Resjardins, and 2,282,012 issued Aug. 22, 1940 to C. F. Waite.

These prior art patents are mentioned as being representative of the prior art and other pertinent patents/references may exist. None of the above cited patents are deemed to affect the patentability of the present claimed invention.

In contrast to the prior art, the present invention provides a self-sharpening scraping tool and tool attachment which utilizes a scraper plate having a scraping edge on all four sides of the plate, one or more sharpening surface means biased to engage one or more inactive blade edges while a manual scraping activity is being conducted with an active (working) blade edge, a pivot or rocker means mounted to said scraper plate to effect relative movement of said scraper plate and, therefore, said blade edges to actuate the sharpening simultaneously with the scraping activity.

SUMMARY OF THE INVENTION

A self-sharpening scraper tool device and/or tool attachment, comprising:

a base member (11) having a pair of spaced apart upturned side walls (14,15), a pair of upwardly projecting biasing blades (12, 13), a sharpening surface means (18, 19), affixed to said side walls, said base member being generally made from a flat sheet of spring type metal such that said biasing blades form leaf springs and said side walls provide inward biasing with being outwardly deflected, a center hole (20) is provided for receiving a mounting bolt or stud (29) therein for affixing said base member unto a tool platform (27), a nut (30) is provided for engaging with said bolt to secure said base member to said tool platform;

a scraper plate member (22) having a flat square plate (51) with a first pair of upwardly bent scraper blades (47, 48) and a second pair of downwardly bent scraper blades (45, 46), said scraper plate having a center hole (31) for receiving said tool bolt (29) with the upwardly bent blades projecting upwardly from said tool platform and the downwardly bent blades each being in contact with a respective sharpening surface (18,19), and a nut means (53) for securing/clamping said scraper plate atop and riding on said biasing blades (12,13).

OBJECTIVES OF THE INVENTION

It is an object of the invention to provide a scraping tool attachment having means for sharpening the scraping blades.

It is a further object of the invention to provide a scraper sharpening adapter designed to fit conventional hand held paint scrapers for sharpening one or more non-active blades using the force or action of the operator while the active blade is in use.

It is a further object of the invention to provide a scraper plate which is pivotally mounted on a hand held type scraper tool.

It is a further object of the invention to provide a rocker plate mounted scraper blade.

It is a further object of the invention to provide a sharpening surface such as a file like blade which is biased into contact with a scraper, blade of a surface scraping tool.

It is a further object of the invention to provide a scraping tool having a pair of spaced apart side walls with blade sharpening surface, thereon.

It is a further object of the invention to provide a new and improved scraping tool.

Other objects and advantages will be apparent to those skilled in the art from the detailed description of the drawings.

BRIEF DESCRIPTION OF THE DRAWINGS

The accompanying drawings illustrate the preferred embodiments of the present invention by way of example. Like numerals refer to like parts throughout.

DETAILED DESCRIPTION OF THE INVENTION

Figure 1:
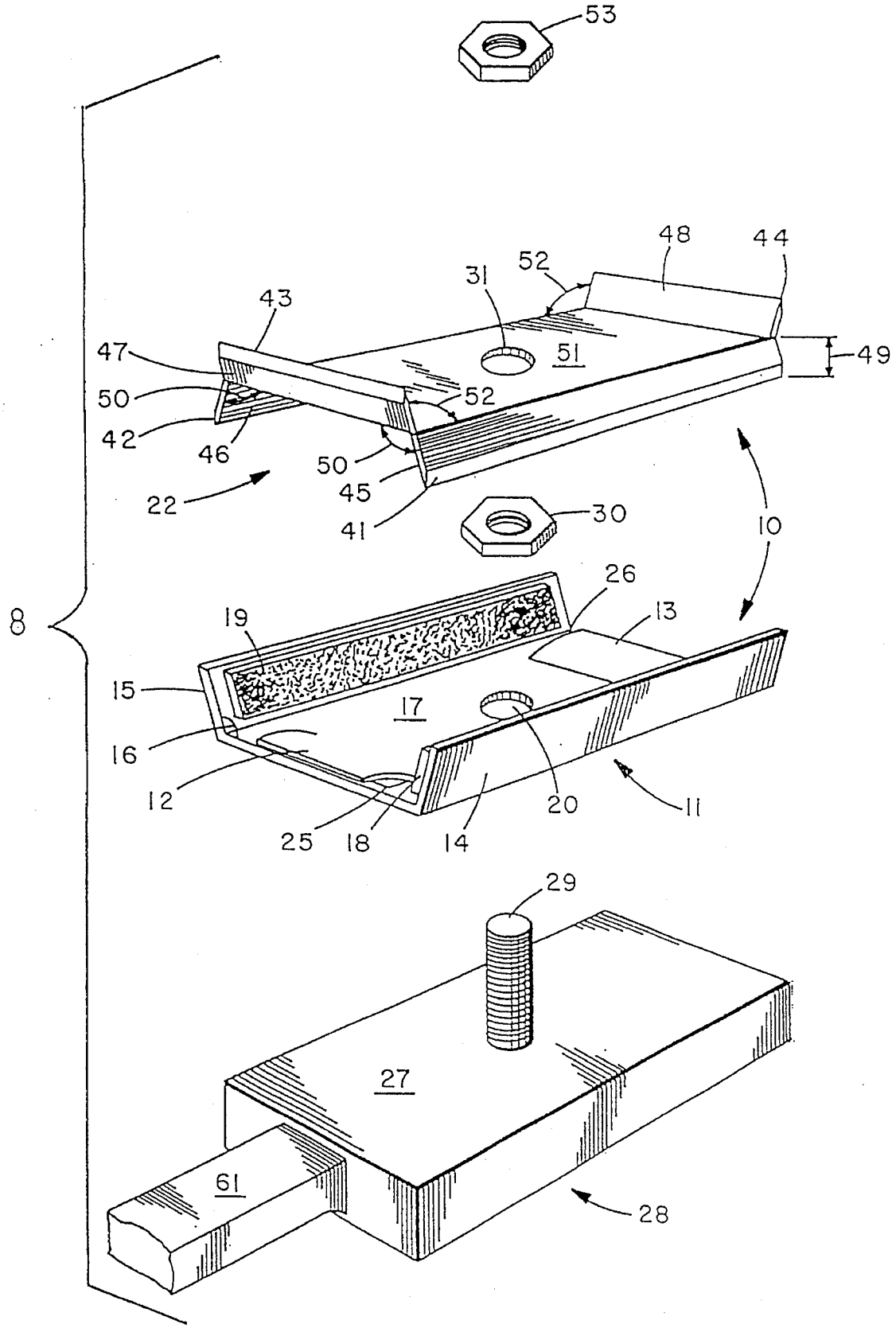
FIG. 1 is an exploded view of a scraper sharpening tool device in accordance with the invention.

Referring to the drawings, particularly FIG. 1, there is shown a self-sharpening scraper tool attachment/adapter 8 constructed in accordance with the invention comprising a base plate 11 and a scraper plate member 22.

The base plate 11 may be formed of metal or other suitable material and includes a pair of spaced part leaf spring members 12, 13, a pair of upwardly inclined projecting side walls 14, 15 each forming an obtuse angle 16 with the base member 17, a sharpening member 18, 19 on each side wall 14, 15, respectively, and a center mounting hole 20.

Preferably, base plate 11 is made from a flat sheet of stainless leaf spring like steel having a square shape. The side walls 14, 15, are formed by bending two sides of the base member 17 upwardly to form the desired obtuse angle 16. Obtuse angle 16 is determined, empirically or otherwise to correspond with a sharpening angle to the sharp scraping edges of scraper plate member 22, as will be explained more fully hereinafter. The spring members 12, 13 may be formed by a stamping process to cut base member 17 along edges 25, 26 and bend-contouring the cantilevered sections to desired height above base plate member 17. The-Height is selected so as to support scraper plate member 22 at a predetermined elevation from base plate member 17 with said tool being fully assembled (see FIG. 3). The thickness and spring quality of base plate 17 is selected for providing a desired spring bias to spring members 12, 13 and side walls 14, 15. This spring biasing effect will be more fully explained hereinafter with particular reference to FIG.3.

Hole 20 is centrally located through base plate 17 to enable the base plate 17 to be placed on the flat support surface 27 of tool member 28, with bolt 29 projecting through hole 20. Nut 30 is then threaded unto bolt 29 to secure base plate 17 firmly unto support surface 27. The length of bolt 29 is-selected or provided such that it extends upwardly above the height of spring members 12, 13 to enable scraper plate member 22 to be mounted atop base plate 11,i.e., bolt 29 inserted through hole 31 of plate member 22. Nut 53 is then screwed onto bolt 29 to secure plate member 22 thereon.

Figure 2:
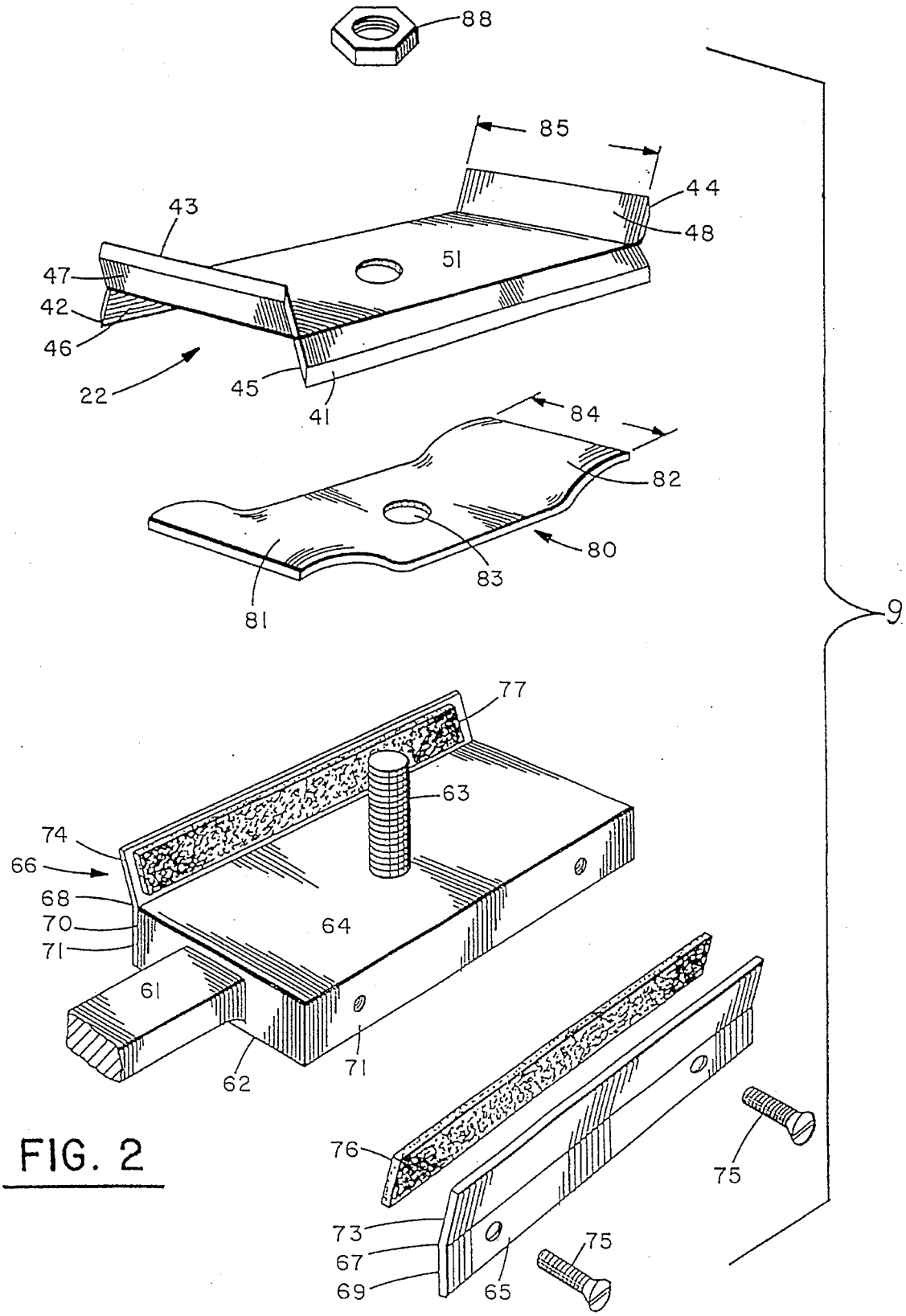
FIG. 2 is an exploded view of an alternative embodiment of a scraper tool in accordance with the invention.

Scraper plate member 22 may be formed from a flat sheet of steel or other suitable material or alloy. Generally speaking, a flat piece of steel having a square configuration is sharpened on its four sides to form four sharp scraping edges 41, 42, 43, 44. The sheet steel is then cut a predetermined length so that upon bending the scraper blades 45 through 48 have the desired width 49 and shape as illustrated in FIGS. 1 and 2, i.e., four individual rectangular shaped scraper blades 45 through 48.The scraper plate member 22 according to the present invention contains a first pair of scraper blades 45,46 each forming an obtuse dihedral angle 50 with plate 51, and a second pair of scraper blades 47, 48 each forming an obtuse dihedral angle 52, with plate 51. Each scraper blade 45 through 48 comprises a respective side edge of plate 51 to form, for example, in clockwise rotation alternating upwardly and downwardly protecting scraper blades. Thus, assuming a clockwise orientation in order to more fully describe scraper plate member 22, blade 47 is bent upwardly, blade 46 is bent downwardly, blade 48 is bent upwardly and blade 45 is bent downwardly.

Scraper plate member 22 is then placed or mounted on base plate member 11 with bolt 29 projecting upwardly through hole 20,and with downwardly projecting scraper blade edges 45, 46 in mating alignment with sharpening surfaces 18, 19, respectively. Nut 53 is then threaded onto bolt 29 and rotated to urge scraper plate member 22 downwardly against the bias of leaf spring members 12, 13 until blade edges 41, 42 matingly engage or abut with sharpening surfaces 18, 19 respectively.

The sharpening surfaces 18, 19 may comprise an elongate rectangular sharpening stone or file which can be affixed to the respective side walls 14,.15, in conventional manner such as, for example, by gluing or other suitable mounting means. Another possible sharpening element may comprise strips of so called emery board or emery cloth (not shown) having an adhesive backing for replaceably affixing the sharpening board/cloth. In this manner, the sharpening surfaces 18, 19 may be periodically replaced as they become worn with use.

From the above it should now be understood that one embodiment of the invention encompasses the provision of an attachment device 11 which can be utilized with conventional scraper tools 28, or, as will be discussed hereinafter with reference to alternative embodiments which incorporate the features of the invention in a new and improved scraper tool.

Figure 3:
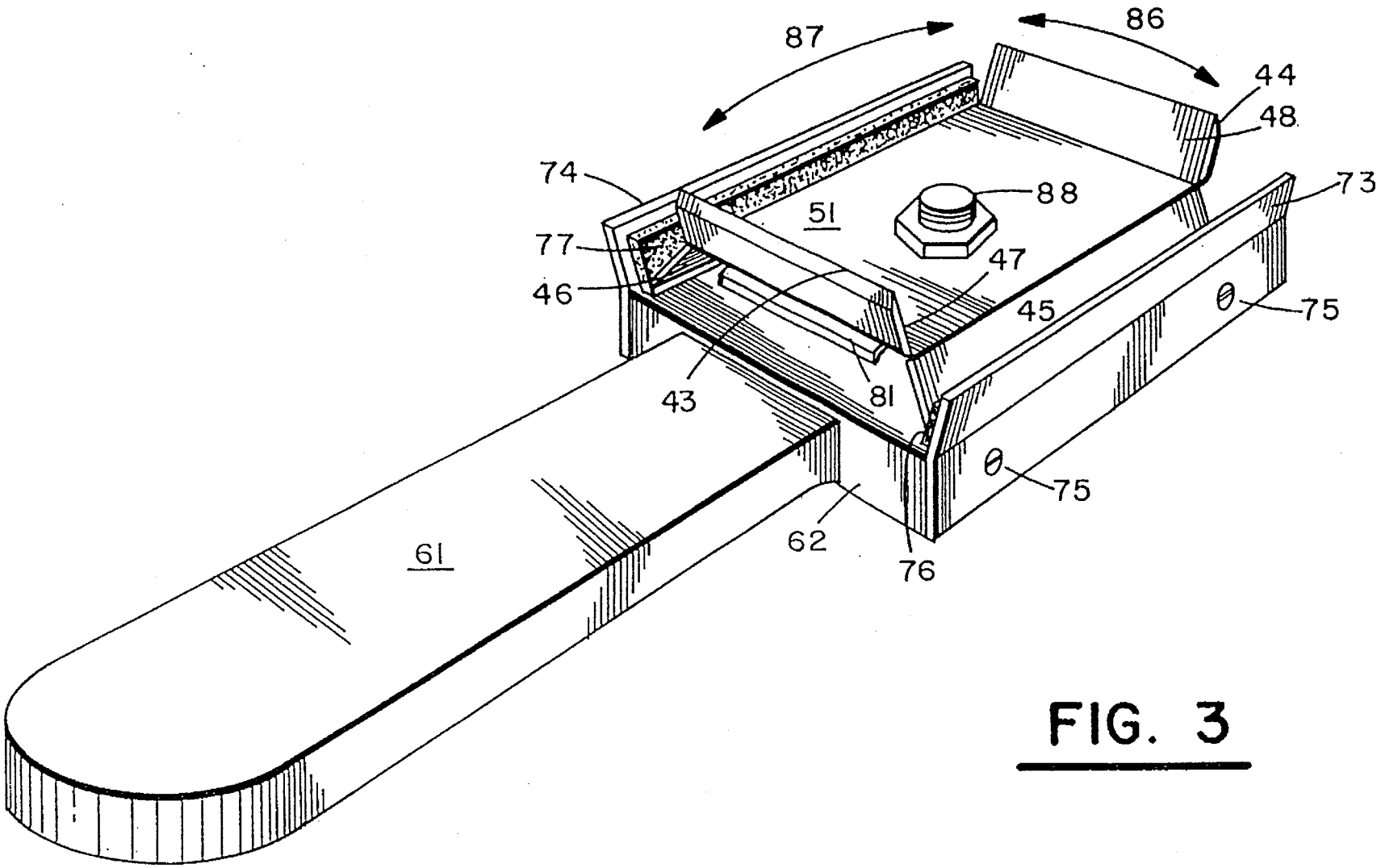
FIG. 3 is a perspective view of the embodiment of the invention illustrated in FIG. 2.
Figure 4:
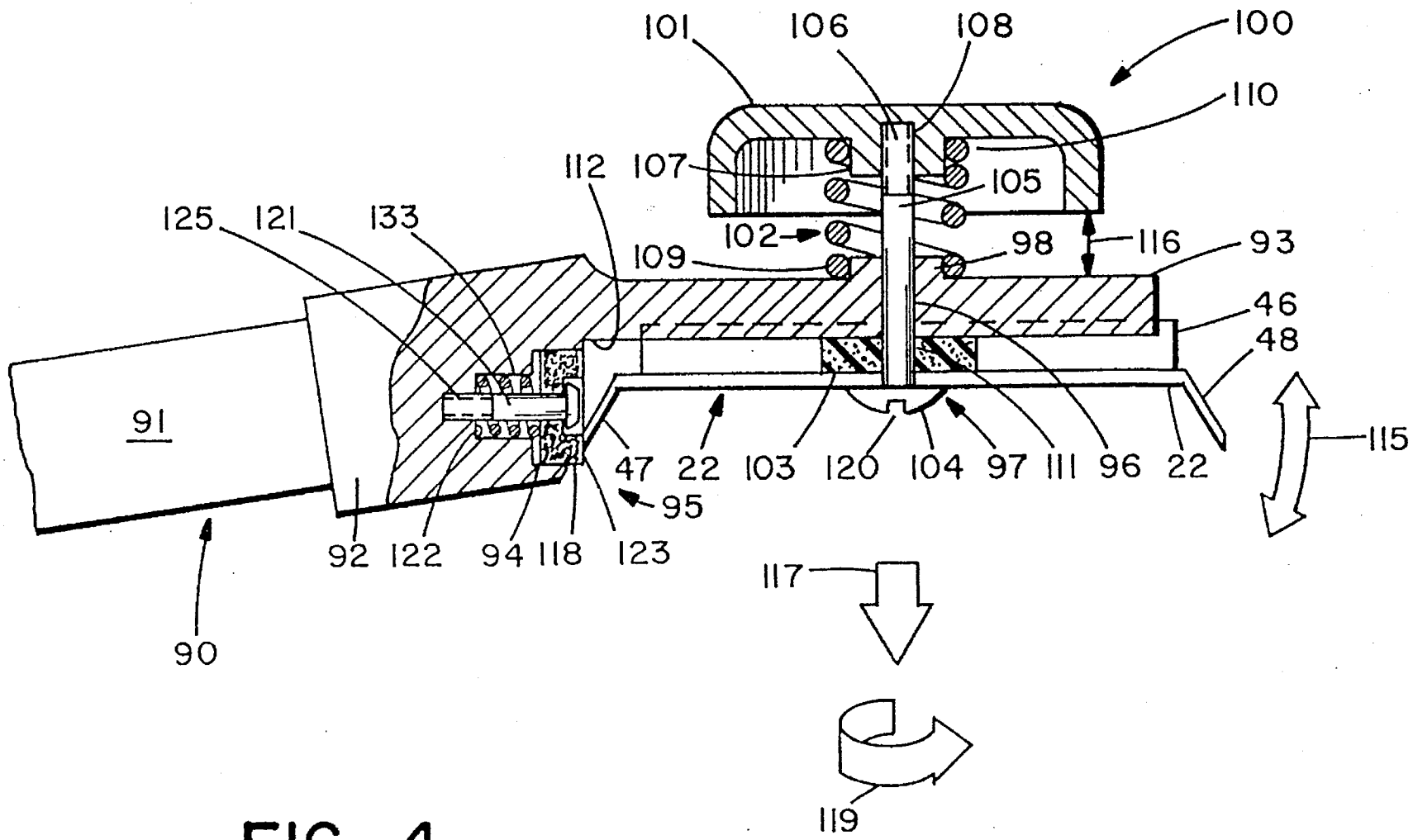
FIG. 4 is a side plan view, partially cutaway ,of an alternative embodiment of the invention.
Figure 5:
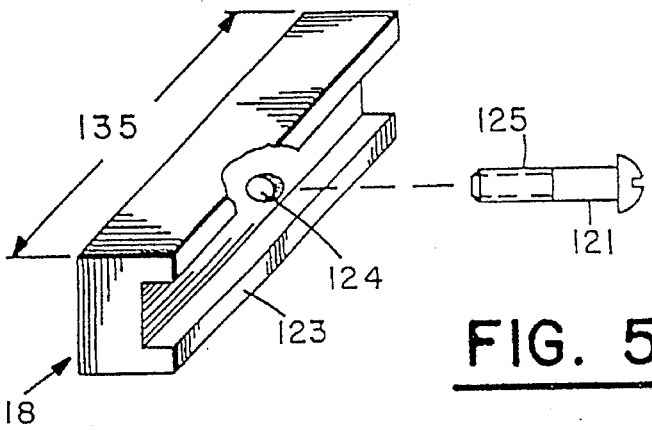
FIG. 5 is a perspective view of the sharpening stone shown in FIG. 4.
Figure 6:
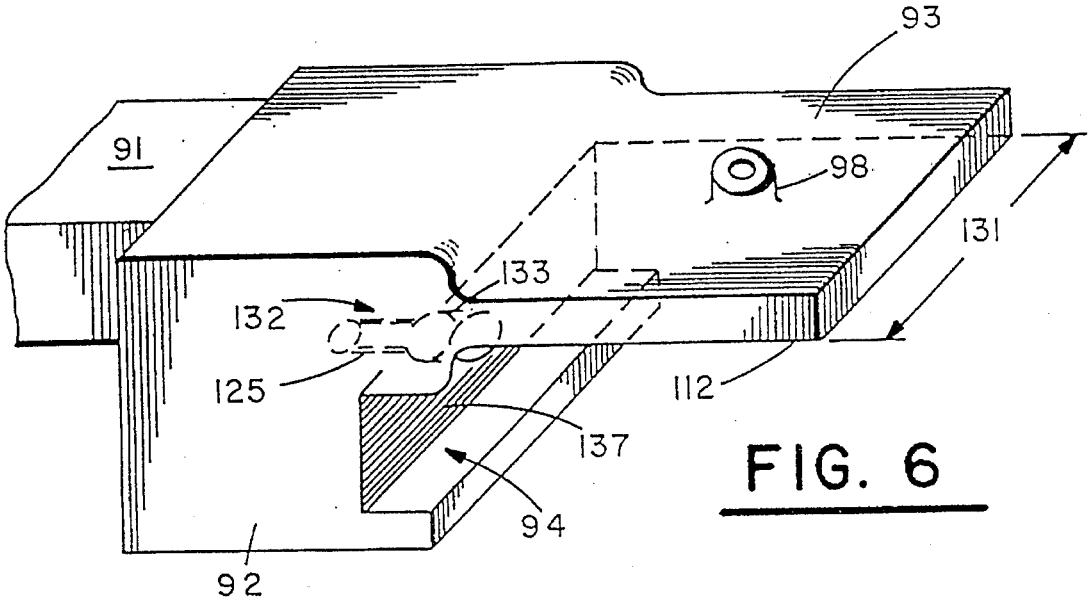
FIG. 6 is a perspective plan view of the head portion of the embodiment illustrated in FIG. 4.
Figure 7:
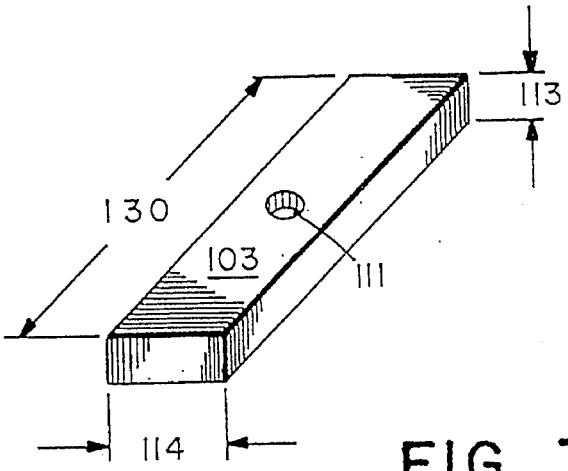
FIG. 7 is a perspective view of the compliant member shown in FIG. 4.
Figure 8:
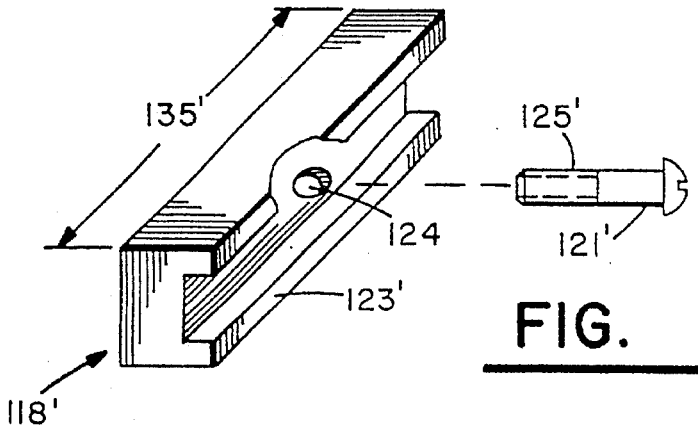
FIG. 8 is a perspective view of a sharpening stone.
Figure 9:
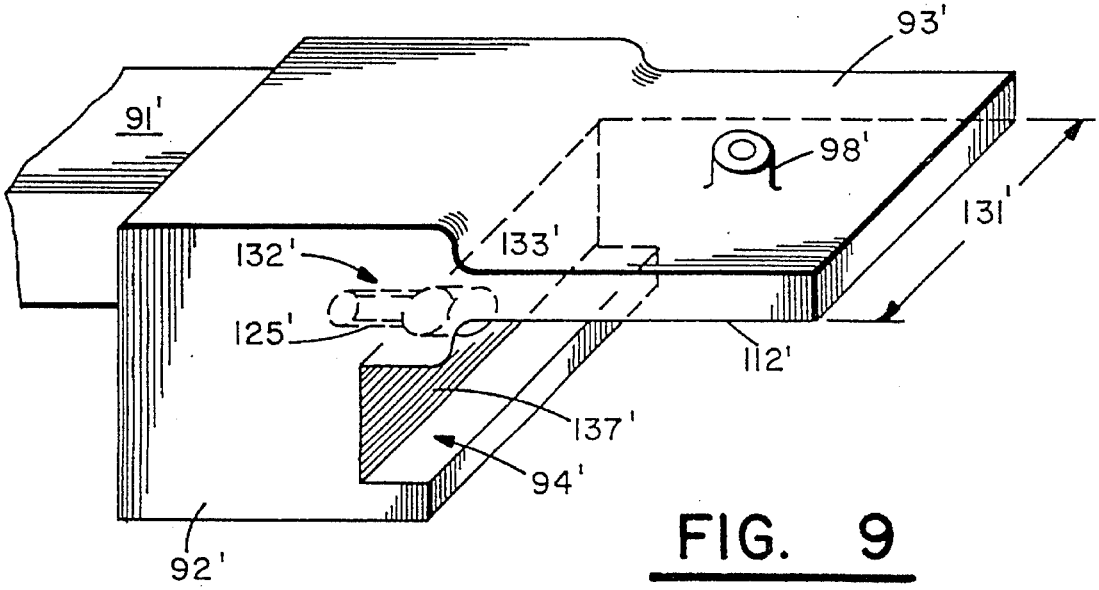
FIG. 9 is a perspective view of a head portion of an embodiment of the invention.

With reference now to FIGS. 2 and 3, an alternative embodiment of the invention is-shown. As illustrated in FIG. 1, the tool 9 comprises an elongate handle 61 affixed at one end to a head member 62 which has a bolt 63 or other fastening means projecting from a top surface 64. The base tool may be formed of plastic, wood or other suitable material.

A pair of upwardly projecting side walls 65, 66, being generally rectangular shaped, are bent 67, 68, to form a flat mating surface 69, 70, with the sides 71,of head member 62, and a pair of spaced apart inclined or sloped wall members 73, 74. The angle of bend 67, 68 is selected to substantially provide wall members 73, 74 with a desired incline for mating with the sharpened edges of the scraper blades of plate member 22. Side walls 65, 66 may be formed of steel or other suitable material selected generally to enable flexing and inward bias when urged outwardly by plate member 22. In this manner, sharpening pressure is maintained on a sharp edge of the scraping blade being in engagement therewith. The side walls 65, 66 may be affixed to the sides 71, by conventional means such as, for example, by screws 75.

Means, such as, a sharpening plate or emery board 76, 77, are mounted to inclined walls 73, 74, respectively.

Base plate 80 contains a pair of oppositely projecting upwardly bent leaf spring like support members 81,82, and a central mounting hole 83. The width 84 of support members 81,82, is selected so as to provide a stable mounting platform for the scraper plate 22. By having the width 84 of support members 81, 82 equal to or slightly less than the width 85 of scraper plate members 22, side-to-side rocking motion as illustrated by double headed arrow 86 is discouraged.

Scraper plate member 22 is the same as described with reference to FIG. 1,i.e., having four discrete scraper blades 45–48 one on each side of scraper plate member 22 in alternating upwardly and downwardly sloped projection about said member 22.

When in the assembled state as illustrated in FIG. 3, the user (not shown) by utilizing the active blade, e.g., blade 48 for scraping a surface, causes a rocking motion as illustrated by! doubleheaded arrow 87 to scraper plate member 22. In this manner, the two then inactive blades 45,46 are sharpened by sharpening surfaces 76,77, respectively.

In operation, when scraper blade 48 becomes dull, nut 88 is unscrewed and plate 22 is rotated so that blade 47 projects outwardly from head 62 and blade 48 is then near the rear of head 62. In other words, blades 47 and 48 are rotated 180 degrees, so that blade 47 is the active blade and blade 48 is the inactive blade, and Nut 88 secured on bolt 63. As the scraping operation continues, blades 45,46 are then being sharpened by sharpening means 76,77, respectively. When blade 47 becomes dull, the scraper plate member 22 is inverted and rotated placing the dull blades 47,48 in the position shown in FIG. 3 as being occupied by blades 45,46, that is engaging sharpening members 76,77. In this position, a new sharp active blade is projected outwardly in scraping disposition similar to that shown prior to plate member 22 being inverted. This process may be repeated numerous times with the dull blades being sharpened while an active blade is in scraping service.

With reference now to FIGS. 4-10, other alternative embodiments of the invention are illustrated. The base tool 90 comprises an elongate handle 91 (shown partially cutaway) affixed at one end to a head member 92. Head member 92 has a square or rectangular blade mounting platform 93 projecting or cantilevered outwardly from head member 92. An alcove or slot 94 is provided transversely across an under section of head member 92, and is configured to slidingly accommodate a sharpening mechanism 95 therein. Blade mounting platform 93 has a generally central hole 96 extending through its thickness to receive a blade mounting bolt 97, and a circular upwardly projecting neck or collar 98.

Scraper plate member 22 is mounted to platform 93 by means of a mounting assembly. 100. Scraper plate member 22, as illustrated in FIG. 1, has four scraper blades 45 through 48 each containing a respective sharp scraping edge 41 through 44.

Mounting assembly 100 generally comprises bolt 97, knob or handle 101, spring 102 and a flexible or compliant washer/spacer .member 103. Mounting bolt 97 has a slotted head portion 104, an elongate intermediate body or shaft portion 105 and a male threaded end portion 106. Handle 101 has a downwardly projecting neck or collar 107 with a central female threaded hole 108 dimensioned for being matingly secured unto the threaded end portion 106 of bolt 97. Handle 101 may be formed from plastic, wood or other suitable material and configured for being hand held and manipulated. Spring 102 generally comprises a helical type spring formed of spring metal and dimensioned for snugly fitting at its bottom ring portion 109 about neck 98 of mounting platform 93,93'. The upper ring portion 110 of spring 102 is dimensioned for snugly fitting about the downwardly projecting neck portion 107 of handle 101. Spacer member 103 comprises an elongate rectangular shaped element such as rubber or other suitable material having a central hole 111 formed therein for receiving a portion of bolt shaft 105. Spacer member 103 is disposed between scraper plate 22 and the bottom surface 112 of platform 93 so as to extend transversely across surface 112,112'. The thickness 113, width 114,length 130 and compression/flexing characteristics of Spacer member 103 may be empirically determined to enable a desired rocking motion of scraper blade 22 as illustrated by the double headed arrow 115. Generally, length 130 is equal to or slightly less than the width 131,131', of mounting platform 93,93'. The length of bolt shaft 105 and, therefore, the spacing 116 between handle 101 and the top surface of blade mounting platform 93,93' is selected, for example, empirically, to enable downward motion of handle ].01 (as illustrated by arrow 117) a distance to enable clearance between sharpening stone 118 and scraper plate member 22. In this manner, the operator (now shown) can rotate handle 101 and, therefore, scraper plate member 22 (as illustrated by arrow 119) to switch or rotate blades 23 and 24 positions without disassembly. Slot 120' is provided in bolt head 104 to facilitate screwing handle 101 unto threaded bolt end 106.

Sharpening mechanism 95 comprises an elongate rectangular shaped sharpening element or stone 118, retaining bolt 121 and outward biasing means or spring 122. Sharpening stone 118 is dimensioned for being snugly but slidingly inserted into slot 94,94' of head member 92. The size and shape of sharpening stone 118 is designed to provide a portion 123 thereof extending outwardly from slot 94,94' to enable engagement with a scraping edge 41, 42, 43 or 44 placed in juxtaposition therewith. Sharpening stone 118 has a central hole 124 for receiving mounting bolt 121 which is screwed into mating threads 125 located within a hole 132,132' in head member 92, at an interior wall section of alcove 94. A biasing means such as helical spring 122 is located in alcove 133 to outwardly urge sharpening stone 118 into contact with a scraping edge of plate 22. As the scraper plate member 22 is rotated as described above other scraping edges may be sharpened while the tool is being used for scraping a surface. Periodically, scraper blade member 22 may be dismantled from mounting assembly 100, and re-assembled for positioning blades 47 and 48 in the upward location illustrated in FIG. 4 as being blade 45 and 46 locations. In this manner, all four blades 45 through 48 may be periodically rotated/positioned in contact with the sharpening stone 118 for being sharpened during the tools use as a surface scraping device. The retaining bolt 121 and spring biasing 122 are designed to provide an outward biasing on sharpening stone 118 for maintaining it in sharpening engagement with a scraping edge, i.e., edge 41 or 42 or 43 or 44 depending on the disposition of plate member 22. The length 135,135' of sharpening stone 118 is equal to or slightly less than the width 131,131' of mounting platform 93. Preferably, stone length 135,135' is equal to or greater than the width 85 of the scraping blades 45, 46, 47, 48.

Figure 10:
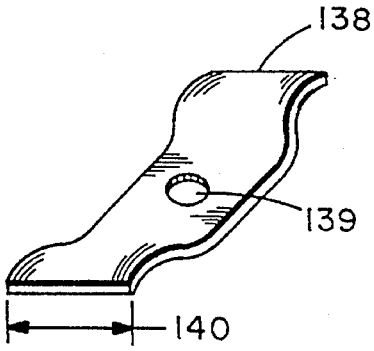
FIG. 10 is a perspective view of a lief spring plate brasing means used in conjunction with the sharpening stone shown in FIG. 8.

It should be understood that other biasing means, for example, a spring plate 138 similar to plate 80 illustrated in FIG. 2 and 10 , may be used in place of helical spring 122. Of course, such spring plate biasing means would be properly dimensioned 140 for being received within alcove 94' with a mounting hole 139 aligned for receiving bolt 121' therein. In this manner, spring arms similar to arm 81 and 82 would be designed to urge each end of sharpening stone 118 outwardly from wall member 137' of alcove 94'.

It is to be understood that the above described arrangements are illustrative of the application of the principles of the invention. Other arrangements may be devised by those skilled in the art without departing from the spirit and scope of the invention.

What is claimed is:

1. A sharpening device in combination with a surface scraping type tool having a scraping plate which contains at least one scraping blade, comprising:

mounting means (100) having a mounting post (97) mounted to the scraping tool for mounting a handle (101) to the scraping tool, and a spring (102) mounted between the scraping tool and said handle (101) and a spacer member mounted between a portion of the scraping tool and the at least one scraping blade(103), for pivotally mounting the scraper plate unto the scraping tool;

sharpening means (95) mounted to the scraping tool for sharpening the at least one scraping blade with a pivotal motion of the pivotally mounted scraper plate.

2. A sharpening device as in claim 1, wherein:

said sharpening means includes a sharpening surface (123) in contact with said at least one scraping blade for sharpening the contacted scraping blade with manual use of the surface scraping tool.

3. A sharpening device as in claim 1, wherein:

said sharpening means includes a sharpening mechanism(95) mounted to the scraping tool for sharpening the at least one scraping blade with a rocking motion of the pivotally mounted scraper plate (22).

4. A sharpening device as in claim 1, wherein:

the sharpening means (95) having a sharpening element (118) being biased into engagement with the at least one scraping blade (47) of the scraper plate (22) by a biasing means (122) mounted between a portion of the surface scraping tool (90) and said sharpening element.

5. A surface scraping tool having particular utility for being hand held and operated for scraping material off a surface area, in combination comprising:

a base tool member (90) having an elongated handle (91) affixed at one end to a head member (92), said head member having a mounting platform portion (93) with collar (98) wall portions defining a central bolt receiving hole (96) extending through said mounting platform, and having an alcove (94) within said head member spaced from said bolt receiving hole;

a sharpening mechanism (95) dimensioned for being mounted within said alcove and comprising a sharpening member (118) and a retaining bolt (121) and an outward biasing means (122,138) for urging said sharpening member outwardly from said alcove;

a scraper plate member (22) having a generally rectangular shape with four scraper blades (45, 46, 47, 48) each projecting at an angle from a respective one side edge of said scraper plate member, and having wall portions defining a center hole (31) extending therethrough;

a mounting assembly means (100) for mounting said scraper plate member to said head member (92) in manually rockable (115) and upward/downward (117) and rotatable (119) disposition relative to said mounting platform portion (93) of said base tool member, said mounting assembly means includes a handle (101) mounted atop said mounting platform portion (93) with an intermediate spring (102) and a mounting bolt (97) being received within said receiving hole (96) and a compliant spacer member (103) disposed between a bottom surface (112) of said mounting platform portion (93) and a first upper portion of said scraper plate member (22) and with a bolt head portion (104) of said mounting bolt (97) being disposed on a lower portion of said scraper plate member, whereby one of said scraper blades (47) is held under biased engagement with the sharpening member (118) such that an upward/downward (117) rocking motion is effected to said scraper plate member causing a sharpening motion to be imparted on the scraper blade (47) in juxtaposition with a surface of said sharpening member (123).

* * * * *